US006889714B1

(12) United States Patent
Sorkin

(10) Patent No.: US 6,889,714 B1
(45) **Date of Patent: *May 10, 2005**

(54) TENDON RECEIVING DUCT FOR A MONOSTRAND BONDED POST-TENSION SYSTEM

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 2 days.

This patent is subject to a terminal disclaimer.

(21) Appl. No.: 10/622,145

(22) Filed: Jul. 18, 2003

Related U.S. Application Data

(63) Continuation-in-part of application No. 10/378,151, filed on Mar. 4, 2003, now Pat. No. 6,666,233, which is a continuation-in-part of application No. 09/752, 126, filed on Dec. 29, 2000, now Pat. No. 6,659,135.

(51) Int. Cl.[7] ..... F16L 11/00
(52) U.S. Cl. ..... 138/121; 138/173; 138/177; 138/110
(58) Field of Search ..... 138/121, 173, 138/177, 110

(56) References Cited

U.S. PATENT DOCUMENTS 3,578,777 A * 5/1971 DeGain ..... 138/121
3,605,817 A * 9/1971 Bauman et al. ..... 138/121
3,715,454 A * 2/1973 Kleykamp ..... 174/47
4,194,081 A * 3/1980 Medford et al. ..... 174/47
4,592,231 A * 6/1986 Kant ..... 73/295
5,439,035 A * 8/1995 Dal PaluúAttilio ..... 138/121
5,706,864 A * 1/1998 Pfleger ..... 138/121
5,720,139 A * 2/1998 Sorkin ..... 52/223.13
5,762,300 A * 6/1998 Sorkin ..... 248/78
5,792,532 A * 8/1998 Pfleger ..... 428/36.9
D400,670 S 11/1998 Sorkin ..... D23/393
5,944,059 A * 8/1999 Masui ..... 138/121
6,550,816 B1 4/2003 Sorkin ..... 285/139.1
6,659,135 B2 * 12/2003 Sorkin ..... 138/121
6,666,233 B1 * 12/2003 Sorkin ..... 138/121

* cited by examiner

*Primary Examiner*—Patrick Brinson
(74) *Attorney, Agent, or Firm*—Harrison & Egbert

(57) ABSTRACT

A tendon receiving duct having a tubular body with a plurality of corrugations extending radially outwardly therefrom. Each of the corrugations is in spaced relationship to an adjacent corrugation. The tubular body has an interior passageway suitable for receiving single tendon therein. Each of the corrugations opens to the interior passageway. The tubular body has at least a first longitudinal channel extending between adjacent pairs of the corrugations on one side of the tubular body and a second longitudinal channel extending between adjacent pairs of the corrugations on another side of said tubular body.

18 Claims, 2 Drawing Sheets

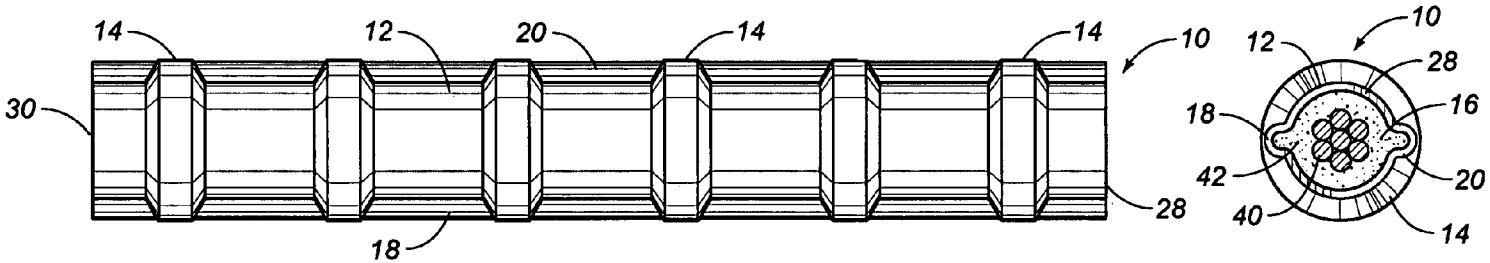
FIG. 4
FIG. 3
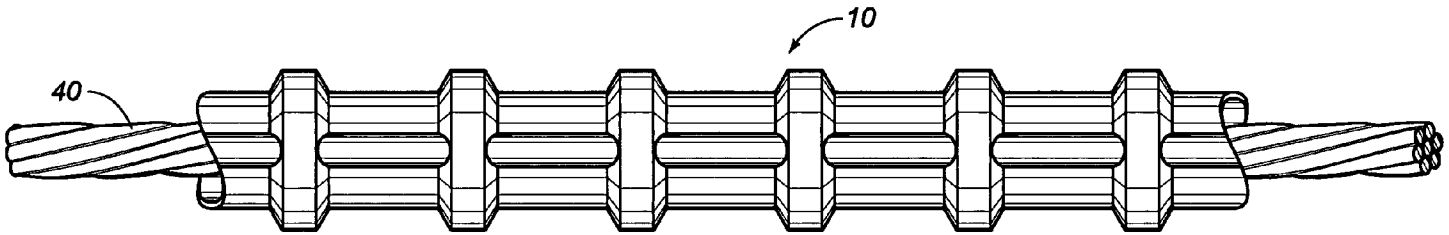
FIG. 5
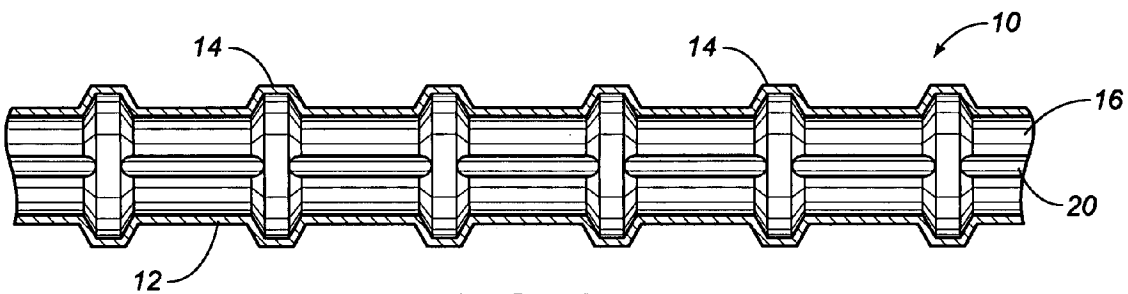
FIG. 6

TENDON RECEIVING DUCT FOR A MONOSTRAND BONDED POST-TENSION SYSTEM

RELATED U.S. APPLICATIONS

The present application is a continuation-in-part of U.S. patent application Ser. No. 10/378,151, filed on Mar. 4, 2003, now U.S. Pat. No. 6,666,233 and entitled "TENDON-RECEIVING DUCT". U.S. patent application Ser. No. 10/378,151 was a continuation-in-part of U.S. patent application Ser. No. 09/752,126, filed on Dec. 29, 2000, now U.S. Pat. No. 6,659,135 and entitled "TENDON-RECEIVING DUCT WITH LONGITUDINAL CHANNELS".

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to ducts as used in post-tension construction. More particularly, the present invention relates to the formation of a polymeric duct used for retaining monostrand tensioning systems within an encapsulated environment.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

Monostrand bonded systems are used when forming long post-tensioned concrete structures, or those which must carry especially heavy loads, such as elongated concrete beams for buildings, bridges, highway passes, etc. A single strand of cable is placed within a duct and then cemented therein in order to achieve the required compressive forces for offsetting the anticipated load. Such bonded monostrand post-tension systems effectively retain the cable in a cemented environment such that if the tension is somehow released from the ends of the tendon, the required compressive forces will still be retained by the cemented tendon. As a result, such bonded monostrand systems are often used where the concrete structure may, at some time in the future, be reduced in size, cut, or otherwise manipulated so as to detach the tensioning anchor from the remainder of the tendon.

In such monostrand systems, it is highly desirable to protect the tensioned steel cable (or tendon) from corrosive elements, such as de-icing chemicals, sea water, brackish water, and even rain water which could enter through cracks or pores in the concrete and eventually cause corrosion and loss of tension of the cable. In such monostrand systems, the cable typically is protected against exposure to corrosive elements by surrounding it with a metal duct or, more recently, with a flexible duct made of an impermeable material, such as plastic. The protective duct extends between the anchors and in surrounding relationship to the cable. Flexible duct, which typically is provided in 20 to 40 foot sections, is sealed at each end to an anchor and between adjacent sections of duct to provide a water-tight channel. Grout then may be pumped into the interior of the duct in surrounding relationship to the cable to provide further protection.

Various patents have issued, in the past, for devices relating to such duct assemblies. For example, U.S. Design Pat. No. 400,670, issued on Nov. 3, 1998, to the present inventor, shows a design of a duct. This duct design includes a tubular body with a plurality of corrugations extending outwardly therefrom. This tubular duct is presently manufactured and sold by General Technologies, Inc. of Stafford, Tex., the licensee of the present inventor.

The present inventor is also the inventor of U.S. Pat. No. 5,474,335, issued on Dec. 12, 1995. This patent describes a duct coupler for joining and sealing between adjacent sections of duct. The coupler includes a body and a flexible cantilevered section on the end of the body. This flexible cantilevered section is adapted to pass over annular protrusions on the duct. Locking rings are used to lock the flexible cantilevered sections into position so as to lock the coupler onto the duct.

U.S. Pat. No. 5,762,300, issued on Jun. 9, 1998 to the present inventor, describes a tendon-receiving duct support apparatus. This duct support apparatus is used for supporting a tendon-receiving duct. This support apparatus includes a cradle for receiving an exterior surface of a duct therein and a clamp connected to the cradle and extending therebelow for attachment to an underlying object. The cradle is a generally U-shaped member having a length greater than a width of the underlying object received by the clamp. The cradle and the clamp are integrally formed together of a polymeric material. The underlying object to which the clamp is connected is a chair or a rebar.

U.S. Pat. No. 5,954,373, issued on Sep. 21, 1999 to the present inventor, shows another duct coupler apparatus for use with ducts on a multi-strand post-tensioning system. The coupler includes a tubular body with an interior passageway between a first open end and a second open end. A shoulder is formed within the tubular body between the open ends. A seal is connected to the shoulder so as to form a liquid-tight seal with a duct received within one of the open ends. A compression device is hingedly connected to the tubular body for urging the duct into compressive contact with the seal. The compression device has a portion extending exterior of the tubular body.

U.S. patent application Ser. No. 09/752,126, filed on Dec. 29, 2000 by the present inventor, describes a tendon-receiving duct having longitudinal channels. In this patent application, two forms of the duct are described. One form has a generally circular cross section and the other form has a generally oval cross section. The longitudinal channels are evenly spaced around the duct. These longitudinal channels extend for the length of the duct and allow each of the corrugations to connect with each other. As a result, when grout is introduced into the interior passageway of the duct, it will flow between the corrugations along the longitudinal channels so as to effectively fill the interior of the duct with grout. The longitudinal channels provide a certain amount of rigidity and straightness to the duct so as to facilitate installation of a plurality of cables (ro tendons) therein. This duct is not particularly designed for use with monostrand systems.

It is an object of the present invention to provided a tendon-receiving duct which can accommodate only a single tendon therein.

It is another object of the present invention to provided a tendon-receiving duct which facilitates the flow of grout throughout the spaces in the interior passageway of the duct between the surfaces of the tendon and the inner wall of the duct.

It is a further object of the present invention to provided a tendon-receiving duct which improves the rigidity of the duct in the longitudinal direction.

It is a further object of the present invention to provided a tendon-receiving duct which facilitates the ability to install the single tendon within duct.

It is a further object of the present invention to provided a tendon-receiving duct which reduces undulations along the length of the duct.

It is a further object of the present invention to provided a tendon-receiving duct which minimizes restrictions during the installation of the tendon on the interior of the duct.

It is a further object of the present invention to provided a tendon-receiving duct which is easy to manufacture, easy to use and relatively inexpensive.

These and other objects and advantages of the present invention will become apparent from a reading of the attached specification and appended claims.

BRIEF SUMMARY OF THE INVENTION

The present invention is a tendon receiving duct comprising a tubular body having a longitudinal axis and plurality of corrugations extending radially outwardly therefrom. Each of the corrugations is in spaced relationship to an adjacent corrugation. The tubular body has an interior passageway suitable for receiving a single tendon therein. Each of the plurality of corrugations opens to the interior passageway. The tubular body has a first longitudinal channel extending between adjacent pairs of the plurality of corrugations on one side of the tubular body. The tubular body has a second longitudinal channel extending between adjacent pairs of the plurality of corrugations on another side of the tubular body.

The longitudinal channels are in spaced parallel relationship to each other. Each of the longitudinal channels is spaced by approximately 180° in respective opposite directions from each other around the circumference of the tubular body.

The first longitudinal channel is positioned on one side of the tubular body. The second longitudinal channel is positioned on an opposite side of the tubular body. The first longitudinal channel and the second longitudinal channel extend for an entire length of the tubular body. Each of the channels opens at opposite ends of the tubular body. The tubular body has a wall extending between the adjacent corrugations. Each of the first longitudinal channel and the second longitudinal channel extends outwardly of this wall. The longitudinal channels open to the interior passageway of the tubular body. Each of the first longitudinal channel and the second longitudinal channel has one end opening to one of the pair of corrugations and an opposite end opening to the other of the pair of corrugations. The longitudinal channels connect the plurality of corrugations in fluid communication. The longitudinal channels extend outwardly of the tubular body by a distance less than the distance that the plurality of corrugations extend outwardly of the tubular body.

The tubular body has a circular cross section in a plane transverse to a longitudinal axis of the tubular body. The tubular body, the plurality of corrugations, the first longitudinal channel and the second longitudinal channel are integrally formed together of a polymeric material.

In an alternative form of the present invention, a single tendon will extend through the interior passageway of the tubular body. A grout material fills the interior passageway of the tubular body. This grout material will also fill the plurality of corrugations and the longitudinal channels. As used herein, the term "tendon" can refer to various items, such as a construction cable, wire rope, a rebar or related items.

BRIEF DESCRIPTION OF THE SEVERAL VIEWS OF THE DRAWINGS

FIG. 3 is an plan view showing the tendon-receiving duct of the present invention.

FIG. 4 is an end view showing the tendon-receiving duct of the present invention with a tendon and associated grout material on the interior of the duct.

FIG. 5 is a side elevational view of the tendon-receiving duct of the present invention with a single tendon extending therethrough.

FIG. 6 is a cross-sectional view of the tendon-receiving duct of the present invention longitudinal channel 20 will have a first end opening at the end 28 of the tubular body 12 and an opposite end opening at the opposite end (not shown) of the tubular body 12. The longitudinal channels 18 and 20 extend outwardly of the wall portions 24. The longitudinal channels 18 and 20 will serve to connect the plurality of corrugations 14 in fluid communication with each other. The longitudinal channels 18–20 extend outwardly of the wall portion 24 of the tubular body 12 by a distance slightly less than the distance that the plurality of corrugations 14 extend outwardly of the tubular body 12. It can be seen that the tubular body 12 has a circular cross section in a plane transverse to the longitudinal axis of the tubular body 12. Each of the tubular body 12, the plurality of corrugations 14, the first longitudinal channel 18, and second longitudinal channel 20 are integrally formed together of a polymeric material in an injection molding process.

Figure 1:
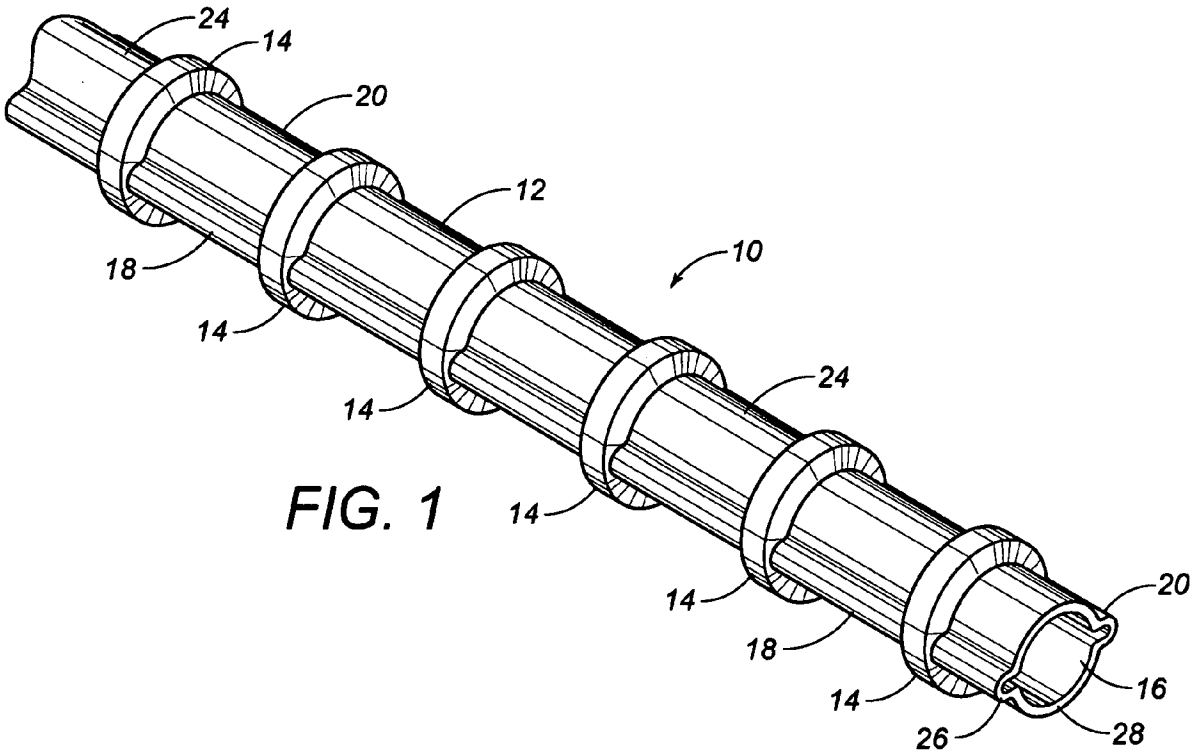
FIG. 1 is an upper perspective view showing the tendon-receiving duct of the present invention.

In normal use, when grout is introduced into the interior passageway 16, it will begin to fill the void within the interior passageway 16. The grout will initially fill the interior of the adjacent corrugation 14 and push air bubbles outwardly therefrom. These air bubbles can migrate along the first longitudinal channels 18 and 20 toward the next corrugation 14. The grout can then flow between the corrugations 14 along the longitudinal channels 18 and 20. Eventually, the grout will fill the channels 18 and 20 and slowly move along the length of the tubular body 12. A suitable valve, or other device, can be used so as to release the migrated air from the interior passageway 16 at the end of the duct 10.

Importantly, the longitudinal channels 18 and 20 provide rigidity and stiffness along the length of the tubular body 12. As a result, the tubular body 12 is less likely to curl up, whip or wobble during the installation of the tendon or cable by a cablepusher. The additional stiffness provided by the longitudinal channels 18 and 20 allows a cable to be installed in a quicker and more convenient.

DETAILED DESCRIPTION OF THE INVENTION

Referring to FIG. 1, there is shown the tendon-receiving duct 10 in accordance with the teachings of the preferred embodiment of the present invention. The tendon-receiving duct 10 includes a tubular body 12 having a plurality of corrugations 14 extending radially outwardly of the tubular body 12. Each of the corrugations 14 is in spaced relationship to an adjacent corrugation 14. The tubular body 12 has an interior passageway 16 suitable for receiving a single tendon (or a post-tension cable) therein. Each of the plurality of corrugations 14 opens within the tubular body 12 to the interior passageway 16. A first longitudinal channel 18 is formed on one side of the tubular body 12 and extends so as to communicate between the corrugations 14. A second longitudinal channel 20 is formed on another side of the tubular body 12. The second longitudinal channel 20 also communicates between the corrugations 14.

The tubular body 12 has a wall section 24 formed between adjacent pairs of corrugations 14 on the tubular body 12. The wall portion 24 defines the inner wall of the interior passageway 16. The longitudinal channel 18 will extend between the corrugations 14 in generally parallel relationship to the longitudinal axis of the tubular body 12. Similarly, the second longitudinal channel 20 will extend between the corrugations 14. Each of the longitudinal channels 18 and 20 has an interior which opens to the interior passageway 16.

As can be seen in FIG. 1, the first longitudinal channel 18 and second longitudinal channel 20 extend for the entire length of the tubular body 12. The first longitudinal channel 18 will have one end 26 opening at the end 28 of the tubular body 12. Similarly, the first channel 18 will have an opposite end opening at the opposite end (not shown) of the tubular body 12. The second manner. There is less likelihood of duct breakage when the tendon is installed. The minimization of whip, wobble, and undulations caused by the construction of the channels 18 and 20 will further reduce the likelihood of duct breakage.

It is important to note that the duct 10 will typically rest on anunderlying surface, such as rebars, post-tension cables, chairs or other supports. The corrugations 14 along with the channels 18 and 20 serve to provide contact points so as to support the tubular body 14 on the underlying surface. As a result, serve to reduce undulations and indentations caused by the underlying surface.

Figure 2:
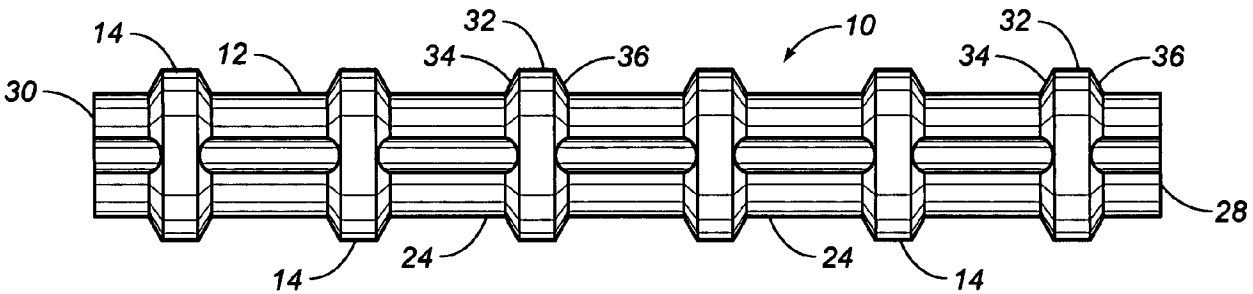
FIG. 2 is a side elevational view showing the tendon-receiving duct of the present invention.

Referring to FIG. 2, there is shown a side elevational view of the duct 10. FIG. 2 clearly shows the construction of the separate corrugations 14 and the manner in which the longitudinal channel 18 extends between adjacent pairs of corrugations 14 on the outer surface of the tubular body 12. Also, it can seen that the longitudinal channel 18 will extend between end 28 and end 30 of the duct 10. The channel 18 is shown as opening at the ends 28 and 30. Importantly, in FIG. 2, it can be seen that each of the corrugations 14 has a flat outer surface 32. Tapered walls 34 and 36 extend toward the wall 34 from the flat surface 32. The tapered walls 34 and 36 will facilitate the flow of grout into and around the corrugation 32. Additionally, the flat outer surface 32 of the corrugations 14 will provide a surface whereby the end 28 of the duct 10 can be self-tapped into a suitable coupler mechanism or to an adjoining structure. Since the channels 18 and 20 extend outwardly of the wall portion 24 for a distance less than the distance that the flat surface 32 extends outwardly from the wall portion 24, the channels 18 and 20 will not be affected by any threaded, self-tapping engagement between the flat surface 32 and an adjoining coupler mechanism.

FIG. 3 shows a plan view of the duct 10. In FIG. 3, it can be seen that the channels 18 and 20 extend outwardly from the tubular body 12 on opposite sides of the tubular body 12. Each of the channels 18 and 20 extends between the end 28 and the end 30 of the tubular body 12. The channels 18 and 20 connect adjacent pairs of corrugations 14. The corrugations 14 are generally evenly spaced from each other along the length of the tubular body 12. The even spacing of the corrugations 14 facilitates the ability to injection mold the duct.

FIG. 4 shows the end view at end 28 of the duct 10. In particular, in FIG. 4, it can be seen that a tendon 40 is received within the interior passageway 16 of the tubular body 12 of duct 10. A grout material 42 is illustrated as filling the space between the inner wall of the tubular body 12 and the outer surfaces of the tendon 40. The grout 42 is particularly illustrated as filling the space defined the longitudinal channels 18 and 20. The grout material 42 will also fill the interior area defined by the corrugations 14.

In FIG. 4, it can be seen that each of the longitudinal channels 18 has a generally inverted U-shaped configuration. The interior of each of the longitudinal channels 18 and 20 opens to the interior passageway 16 of the tubular body 12. The channels 18 and 20 are particularly illustrated on opposite sides of the tubular body 12 spaced by approximately by 180° from each other. The corrugations 14 are illustrated as extending radially outwardly of the tubular body 12 around the entire circumference of the tubular body 12.

FIG. 5 shows the duct 10 as having the tendon 40 extending longitudinally therethrough. Since the duct 10 has an extended length, FIG. 5 only shows a portion of the entire length of the duct 10. In normal use, the ends of the duct 10 will extend entirely around the tendon 40. FIG. 5 simply shows the tendon 40, for purposes of illustration, as extending outwardly of the duct 10 in a broken-away. FIG. 5 also shows that only a single tendon is received within the interior of the duct 10.

FIG. 6 shows a cross-sectional view of the duct 10. In FIG. 6, it can be seen that the corrugations 14 open to the interior passageway 16 of the tubular body 12. Similarly, it is shown that the longitudinal channel 20 opens to the interior passageway 16. In normal use, the arrangement of corrugations 14, along with the longitudinal channels 18 and 20, will facilitate the flow of grout entirely throughout the length of the duct 10.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A tendon receiving duct comprising:

a tubular body having a longitudinal axis, said tubular body having a plurality of corrugations extending radially outwardly therefrom, each of said plurality of corrugations being in spaced relation to an adjacent corrugation, said tubular body having an interior passageway suitable for receiving a single tendon therein, each of said plurality of corrugations opening to said interior passageway, said tubular body having at least a first longitudinal channel extending between adjacent pairs of said plurality of corrugations on one side of said tubular body and a second longitudinal channel extending between adjacent pairs of said plurality of corrugations on an opposite side of said tubular body, each of said first and second longitudinal channels extending outwardly of said tubular body by a distance less than a distance that said plurality of corrugations extends outwardly of said tubular body, said first longitudinal channel and said second longitudinal channels extending for an entire length of said tubular body, each of first and second longitudinal channels in fluid communication with said interior passageway.

2. The duct of claim 1, said first longitudinal channel being diametrically opposed from said second longitudinal channel around said tubular body.

3. The duct of claim 1, each of said first longitudinal channel and said second longitudinal channel opening at opposite ends of said tubular body.

4. The duct of claim 1, said tubular body having a wall extending between adjacent corrugations, each of said first longitudinal channel and said second longitudinal channel extending outwardly of said wall.

5. The duct of claim 1, each of said first longitudinal channel and said second longitudinal channel having one end opening to one of said pair of corrugations and an opposite end opening to the other of said pair of corrugations.

6. The duct of claim 1, said first longitudinal channel and said second longitudinal channel connecting said plurality of corrugations in fluid communication.

7. The duct of claim 1, said tubular body having a circular cross-section in a plane transverse to said longitudinal axis of said tubular body.

8. The duct of claim 1, said tubular body and said plurality of corrugations and said first longitudinal channel and said second longitudinal channel being integrally formed together of a polymeric material.

9. An apparatus comprising:

a tubular body having a longitudinal axis and an interior passageway, said tubular body having a plurality of corrugations extending radially outwardly therefrom, each of said plurality of corrugations being in spaced relation to an adjacent corrugations, said tubular body having at least a first longitudinal channel formed on one side of said tubular body and a second longitudinal channel formed on another side of said tubular body, said first and second longitudinal channels being in spaced relationship to each other, said tubular body having a circular cross-section in a plane transverse to said longitudinal axis of said tubular body, said first and second longitudinal channels being in fluid communication with said interior passageway and said plurality of corrugations;

a single tendon extending through said interior passageway of said tubular body; and a grout material filling at least a portion of said interior passageway of said tubular body.

10. The apparatus of claim 9, said grout material filling said plurality of corrugations and said first longitudinal channel and said second longitudinal channels.

11. A tendon receiving duct comprising:

a tubular body having a longitudinal axis, said tubular body having an interior passageway suitable for receiving a single tendon therein, said tubular body having a plurality of corrugations extending radially outwardly therefrom, said tubular body having at least a first longitudinal channel formed on one side of said tubular body and a second longitudinal channel formed on another side of said tubular body, said first and second longitudinal channels being in spaced parallel relationship to each other, said first longitudinal channel and said second longitudinal channel extending for a length of said tubular body, each of said first longitudinal channel and said second longitudinal channel opening to and in fluid communication with said interior passageway, each of said plurality of corrugations having a flat outer surface, each of first and second longitudinal channels extending outwardly of said tubular body by a distance less than a distance that said plurality of corrugations extends outwardly of said tubular body, said tubular body having a circular cross-section in a plane transverse to said longitudinal axis.

12. The duct of claim 11, said first longitudinal channel being diametrically opposite said first longitudinal channel around said tubular body.

13. The duct of claim 11, each of said plurality of corrugations being in spaced relationship to an adjacent corrugation, each of said plurality of corrugations opening to and in fluid communication with said interior passageway, said first longitudinal channel extending between adjacent pairs of said plurality of corrugations, said second longitudinal channel extending between adjacent pairs of corrugations.

14. The duct of claim 11, said first longitudinal channel and said second longitudinal channel extending for an entire length of tubular body, each of said first longitudinal channel and said second longitudinal channel opening at opposite ends of said tubular body.

15. The duct of claim 13, said plurality of corrugations and said first longitudinal channel and said second longitudinal channel being integrally formed together of a polymeric material.

16. The duct of claim 11, further comprising:

a single tendon extending through said interior passageway of said tubular body.

17. The duct of claim 16, further comprising:

a grout material filling a space in said interior passageway between said single tendon and an inner wall of said tubular body.

18. The duct of claim 17, said grout material filling said first and second longitudinal channels.

* * * * *